US005187408A

United States Patent [19]

Jödicke et al.

[11] Patent Number: 5,187,408

[45] Date of Patent: Feb. 16, 1993

[54] QUASI-OPTICAL COMPONENT AND GYROTRON HAVING UNDESIRED MICROWAVE RADIATION ABSORBING MEANS

[75] Inventors: Bernd Jödicke, Unterehrendingen; Hans-Günter Mathews, Oberehrendingen, both of Switzerland

[73] Assignee: Asea Brown Boveri Ltd., Baden, Switzerland

[21] Appl. No.: 636,731

[22] Filed: Jan. 2, 1991

[30] Foreign Application Priority Data

Jan. 15, 1990 [CH] Switzerland ..... 114/90
May 29, 1990 [CH] Switzerland ..... 1819/90

[51] Int. Cl.[5] ..... H01J 23/54

[52] U.S. Cl. ..... 315/5; 333/22 F; 333/251; 333/228; 331/79

[58] Field of Search ..... 315/4, 5, 39; 333/227, 333/81 B, 22 F, 251, 228; 331/79, 91

[56] References Cited

U.S. PATENT DOCUMENTS

| | | | |
|---|---|---|---|
| 3,483,418 | 12/1969 | Bittorf et al. | 315/3.5 |
| 3,636,402 | 1/1972 | Horigome | 315/3.6 |
| 3,983,356 | 9/1976 | Jurgensen | 333/22 F X |
| 4,189,660 | 2/1980 | Dandl | 315/5.38 |
| 4,494,039 | 1/1985 | Kim | 333/81 B X |
| 4,705,988 | 11/1987 | Tran et al. | 315/5 X |
| 4,740,763 | 4/1988 | Wilhelm et al. | 333/22 F |
| 4,799,031 | 1/1989 | Lang et al. | 333/81 B X |

FOREIGN PATENT DOCUMENTS

| | | | |
|---|---|---|---|
| 177668 | 4/1986 | European Pat. Off. . | |
| 301929 | 2/1989 | European Pat. Off. . | |
| 2043565 | 3/1972 | Fed. Rep. of Germany | 333/81 B |
| 2256817 | 6/1974 | Fed. Rep. of Germany . | |
| 997494 | 1/1952 | France . | |
| 720780 | 3/1960 | France . | |
| 664044 | 1/1988 | Switzerland . | |
| 472598 | 8/1976 | U.S.S.R. | 315/5 |
| 797538 | 10/1981 | U.S.S.R. | 315/4 |
| 2152742 | 8/1985 | United Kingdom | 315/5 |

OTHER PUBLICATIONS

Design of the CIT Gyroton ECRH Transmission System, J. A. Casey et al., pp. 123 and 124, 13th International Conference on Infrared and Millimeter Waves, Dec. 5-9, 1988.

SPIE-The International Society of Optical Engineering, Thirteenth International Conference on Infared and Millimeter Waves, "An X-Band Vlasov-Type Mode Converter", B. G. Ruth et al., pp. 119-120, vol. 1039, Dec. 5-9, 1988.

A Quasi-Optical Converter For Efficient Conversion of Whispering Gallery Modes Into Narrow Beam Waves, A. Mobius et al., pp. 121-122, 13th Int'l Conference on Infared and Millimeter Waves, Dec. 5-9, 1988.

*Primary Examiner*—Paul M. Dzierzynski
*Assistant Examiner*—Benny T. Lee
*Attorney, Agent, or Firm*—Oblon, Spivak, McClelland, Maier & Neustadt

[57] ABSTRACT

A quasi-optical component for microwave radiation comprises a quasi-optical element (16*a*) which radiates incident microwave radiation along a major axis (19) and which has a characteristic transverse dimension (D) which is smaller than 50-times one wavelength. It is distinguished by the fact that a cooled absorption device (17) is provided which is arranged closely in front of the quasi-optical element (16*a*) in such a manner that at least one high-power secondary peak (20) of the diffraction due to the characteristic transverse dimension is destroyed.

12 Claims, 4 Drawing Sheets

QUASI-OPTICAL COMPONENT AND GYROTRON HAVING UNDESIRED MICROWAVE RADIATION ABSORBING MEANS

BACKGROUND OF THE INVENTION

1. Field of the Invention

The invention relates to a quasi-optical component for microwave radiation comprising a quasioptical element which radiates incident microwave radiation along a major axis and which has a characteristic transverse dimension which is smaller than 50 times one wavelength.

2. Discussion of Background

For using microwaves for heating fusion plasmas, very high powers (1–30 MW) are needed in the range from approximately 50 GHz. As has been shown by studies, these powers can be best controlled by means of so-called quasi-optical components. The term quasioptical denotes the principle that microwaves are no longer conducted by conducting walls but propagate approximately under free-space conditions.

Such quasi-optical components can be used in the heating of plasmas by means of microwaves at different positions, for example in the microwave source (quasi-optical or also cylindrical gyrotron) or in the transmission system (compare "Design of the CIT Gyrotron ECRH Transmission System", J. A. Casey et al., 13th Int. Conf. on Infrared and Millimeter Waves, Dec. 5–9, 1988, pp. 123–124). In connection with the cylindrical gyrotron, the so-called Vlasov convertor, above all, is of significance. Such a quasi-optical element is described, for example, in the publications "An X-Band Vlasov-Type Mode Convertor", B. G. Ruth et al., 13th Int. Conf. on Infrared and Millimeter Waves, Dec. 5–9, 1988, pp. 119–120, and "A quasi-optical convertor for efficient conversion of whispering gallery modes into narrow beam waves", A. Möbius et al., 13th Int. Conf. on Infrared and Millimeter Waves, Dec. 5–9, 1988, pp. 121–122. The example of the gyrotron will be used for explaining that, however, quasi-optical components also entail problems.

In the gyrotron, an electron beam gun generates an electron beam which passes via a drift system into a resonator where a part of the kinetic energy of the electrons is converted into the desired microwave radiation.

The quality of the electron beam plays a central role for the optimum excitation of the microwaves. So that the beam quality along the drift system is impaired as little as possible, it must be ensured that the electrons are always subject to an electrical potential in this system. In principle, this can be achieved by means of a cylindrical or possibly conical metal tube which has a diameter which is a few millimeters larger than the electron beam.

However, this tube can also resonate. This would result in a dramatic deterioration in the beam quality. This is why suitable means must be used for ensuring that no microwaves can be generated in this area. In addition, this area has the task of damping microwaves which pass from the resonator to the gun.

At present, there are two solutions for this problem. One is provided in the published Patent Application EP-0 301 929 Al. In this publication, in the case of a cylindrical gyrotron a conical beam guide with ribbed metallic inner surface is arranged in the drift system. Between the metal ribs protruding toward the inside, absorbing rings of magnesium oxide are arranged.

This solution has the following principle of operation. The copper ring protruding slightly toward the inside forms the electrical surface. The damping ring behind it does not influence the electron movement but damps the microwaves. The disadvantage of this solution which is used in most cases is the high price of the damping ceramics and the poor thermal coupling of the ceramics to a heat sink. In addition, the interior of this beam conductor cannot be easily pumped.

The second solution is known from the Patent CH-664,044 A5. The electrically conducting surface of the beam guide is here achieved by a metal grid enclosing the electron beam. The structure is provided with the characteristic of resonance damping by means of the penetrations in the grid. They are dimensioned in such a manner that they pass the microwaves to be damped. In this solution, the undefined absorption of the microwaves represents a problem.

Further problems occur in conjunction with microwaves which are coupled back from the resonator into the electron beam space and can develop a similarly disturbing effect.

SUMMARY OF THE INVENTION

It is the object of the invention to specify quasi-optical components of the type initially mentioned, which avoid the problems existing in the prior art.

In particular, it is also the object of the invention to specify a gyrotron in which in an evacuated vessel, a) an electron gun for generating an electron beam, b) a drift system with a beam guide for the electron beam generated, which exhibits an electrically conductive inside surface enclosing the electron beam and having openings for damping unwanted microwave radiation, and c) a resonator, are arranged behind one another along an electron beam axis, in which resonator kinetic energy of the electron beam is converted into desired microwave radiation, in which gyrotron the electron beam is guided along the drift system without impairment of quality.

According to the invention, the solution consists in that the component comprises a cooled absorption device which is arranged closely in front of the quasi-optical element in such a manner that at least one high-power secondary peak of the diffraction due to the characteristic transverse dimension is destroyed.

The core of the invention consists in that the disturbing microwaves are damped or destroyed as closely as possible to their point of origin (reflector, convertor and so forth) before they can act in an uncontrolled manner on the electron beam or on some sensitive components of the gyrotron. According to the invention, the damping body is preferably mounted at the points of the expected secondary peaks. It should be capable of dissipating the high power (typically between 1% and 10% of the beam power). The damping body essentially consists of a dielectric vessel having relatively low losses for the microwaves (transparent) and a dielectric fluid (absorption). The absorption capability of the fluid is not too great, on the one hand, so that film boiling cannot occur and, on the other hand, not too low so that the secondary peaks can be essentially destroyed, nevertheless. Such fluids are known, for example, from the technology of microwave calorimeters.

The absorption device comprises a vessel which is transparent to microwaves, particularly of ceramics (for example aluminum oxide ceramics), which is filled with a cooling liquid absorbing the microwaves, particularly water. The quasi-optical element is preferably a focusing reflector or a Vlasov-type convertor.

A gyrotron according to the invention is distinguished by the fact that a cooled absorption device enclosing the beam guide is provided for the absorption of the microwave radiation emerging through the openings of the beam guide.

An essential advantage of this embodiment lies in the fact that the microwaves are first scattered away radially which results in the damping of the microwave radiation in the internal space, and are then absorbed by separate means. The last-mentioned means can be designed in a simple manner for the required cooling capacity because of their spatial separation from the actual beam guide. In addition, the microwave energy is destroyed in a well-defined space. Finally, the absorbing structure can be actively cooled in the invention.

According to an advantageous embodiment, the beam guide exhibits several metal rings axially spaced apart with intermediate spaces on the axis. An advantage of this embodiment lies in the fact that the internal space of the beam guide can be satisfactorily pumped out.

At low frequencies (less than about 70 GHz), it is particularly advantageous if the beam guide exhibits a section with metal rings and a section with metal rods arranged in the form of a jacket around the said axis. In that case, both TE and TM modes can be easily coupled out.

It is particularly advantageous if the cooled absorption device is formed by a double-walled hollow cylinder, the inside and outside wall of which completely consists of a material transparent to microwaves, preferably of an aluminum oxide ceramic, and through which a cooling medium absorbing the microwaves, preferably water, flows. The vessel is completely accommodated in the evacuated tube vessel. Such an absorption device can be integrated without problems in a gyrotron of known construction. The costs of this absorption device are much lower than those of a solution known from the prior art.

The metal rings are preferably copper rings which are kept at a distance with the aid of pins. The optimum axial spacing of the metal rings and thus the intermediate space between two metal rings each is in each case at least one half wavelength of the microwave radiation to be damped. These measures ensure the desired good damping characteristics of the beam guide. The intermediate spaces are largely free of obstructing parts.

At low frequencies (<70 GHz), that is to say at long wavelengths, the distance does not necessarily need to correspond to one half wavelength but can also be smaller. In this case, however, the supporting metal pins should have a mutual spacing of at least one half wavelength. The microwaves are then coupled out through intermediate spaces in then shape of long (transversely to the axis), thin (longitudinally to the axis) slots.

Instead of metal rings, also suitable are metal rods which also surround the electron beam in the form of a jacket and are held at a distance by suitable holding rings.

Apart from the beam conductor according to the invention of metal rings, the grid beam conductor known holding rings.

It is particularly advantageous if in a gyrotron according to the invention, the inside wall of the cooled absorption device forms a section of the wall of the evacuated vessel and the outside wall (of metal) of the hollow cylinder is placed externally onto said vessel. In such an embodiment, there are fewer sealing problems because no coolant feed lines need to be brought into the evacuated vessel 12 and there are only two vacuum-tight connections (at both ends of the ceramic cylinder).

Further advantageous embodiments are obtained from the totality of the dependent patent claims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 3:
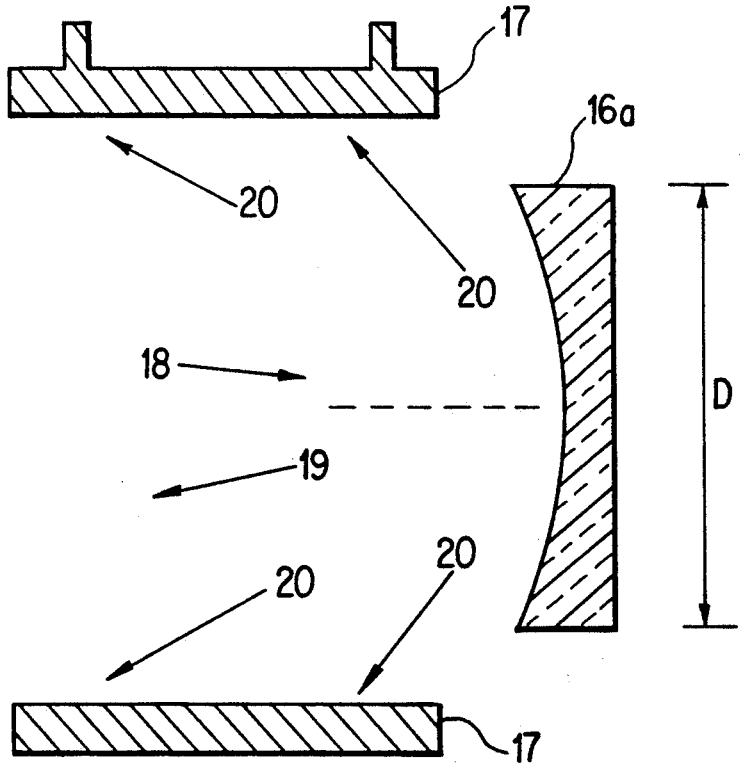
FIG. 3 shows a quasi-optical component comprising a focusing reflector.

Referring now to the drawings, wherein like reference numerals designate identical or corresponding parts throughout the several views, FIG. 3 is used as the simplest example for explaining the principle of the invention. The quasi-optical component shown comprises a focusing reflector 16*a* as a quasi-optical element and a hollow-cylindrical vessel 17 as absorption device. The microwaves are incident along a predetermined direction of incidence 18. The reflector 16*a* reflects the microwaves essentially to the direction of a major axis 19. The reflector has a diameter D (=transverse dimension) which is typically less than 50-times one wavelength. The wavelength, in turn, is in the millimeter or submillimeter band, that is to say approximately between 10 and 0.1 mm. The relatively small transverse dimension results in diffraction at the reflector as a whole. The corresponding secondary peaks, which contain between 1% and 10% of the total beam power (1-30 MW) are no longer negligible (for example easily 20 kW and more at 1 MW).

According to the invention, the absorbing vessel 17 is arranged to be as close as possible to the quasi-optical component, that is to say the reflector 16*a* so that the unwanted secondary peaks are absorbed. In the figure, the energy distribution in the microwave beam is indicated. The first secondary peak 20, which is the strongest in this case, is just damped. Other secondary peaks also disappear in the vessel 17.

FIG. 3 shows the general case where direction of incidence and exit (major axis) no longer coincide. This case occurs, for example, in the quasi-optical transmission of the microwave radiation from a source (gyrotron) to a load (fusion reactor). Focusing reflectors which again focus the spreading beam are installed at certain intervals. This makes it possible, for example, to transport the microwaves over a relatively long distance ($10-10^5$ times the wavelengths).

Figure 4:
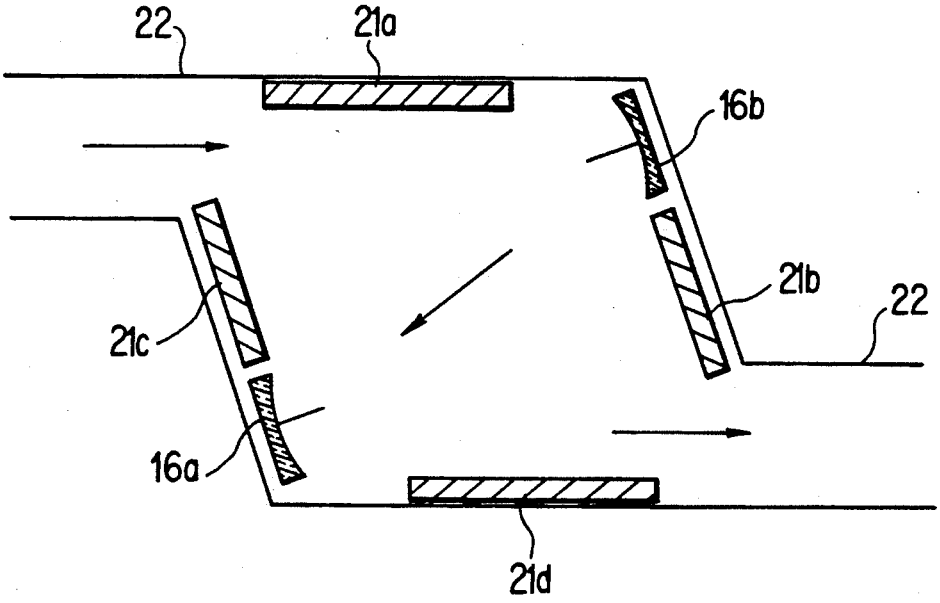
FIG. 4 shows a transportation line comprising two quasi-optical components.

FIG. 4 shows an embodiment suitable for the transmission of the microwaves. Two reflectors 16*a* and 16*b* are provided which produce the desired focusing of the radiation. They are accommodated, for example, in a transportation line 22 which itself does not act as waveguide (quasi-optical case) but only forms a protection against accidental interruption of the beam path. Close to the reflectors 16*a*, 16*b*, the wall of the transportation line 22 is shielded in accordance with the invention by means of absorption devices 21*a*, . . . 21*d*. Depending on the shape of the wall, these can be flat disk-shaped vessels or curved ones (sectors of a double-walled hollow cylinder). Through these water preferably flows as a cooling medium. The unwanted secondary peaks are thus eliminated immediately after they are produced.

Figure 5:
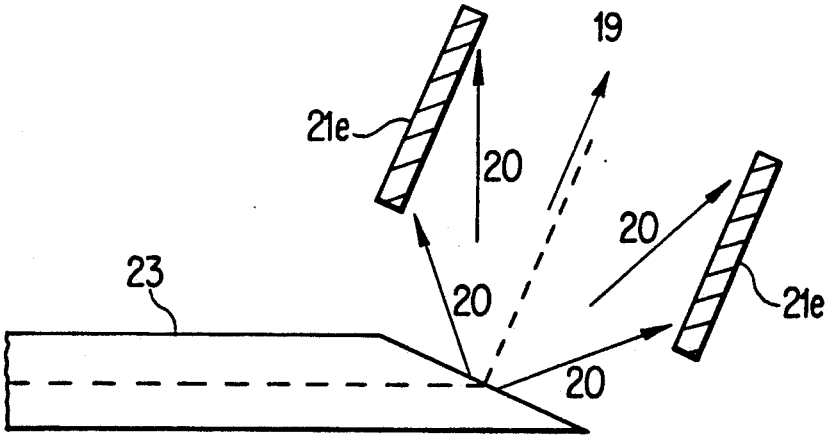
FIG. 5 shows a quasi-optical component comprising a Vlasov-type convertor.

FIG. 5 shows a further example of a quasi-optical component according to the invention. A Vlasov-type convertor 23 radiates the modes conducted in the tube as a Gaussian wave in the direction of a major axis 19. An absorption device 21*e* (for example water-filled vessel) enclosing the major axis and, for example, rotationally symmetric, destroys the disturbing secondary peaks 20.

The invention is also used with great advantage in a gyrotron. In this arrangement, a fundamental distinction can be made between two aspects. On the one hand, it is a matter of protecting the electron beam against "straying" microwaves and, on the other hand, of suppressing stray radiation in the resonator. Firstly, the problems relating to the electron beam will be discussed.

From Patent Specification CH-664,044 A5 previously mentioned, a gyrotron with a grid beam guide is known. The invention now specifies an improved possibility for beam guides. In principle, however, the means according to the invention are accommodated at the same place in the gyrotron as the beam guide in the prior art. It is therefore sufficient if the known features of the gyrotron are only indicated here.

Figure 1:
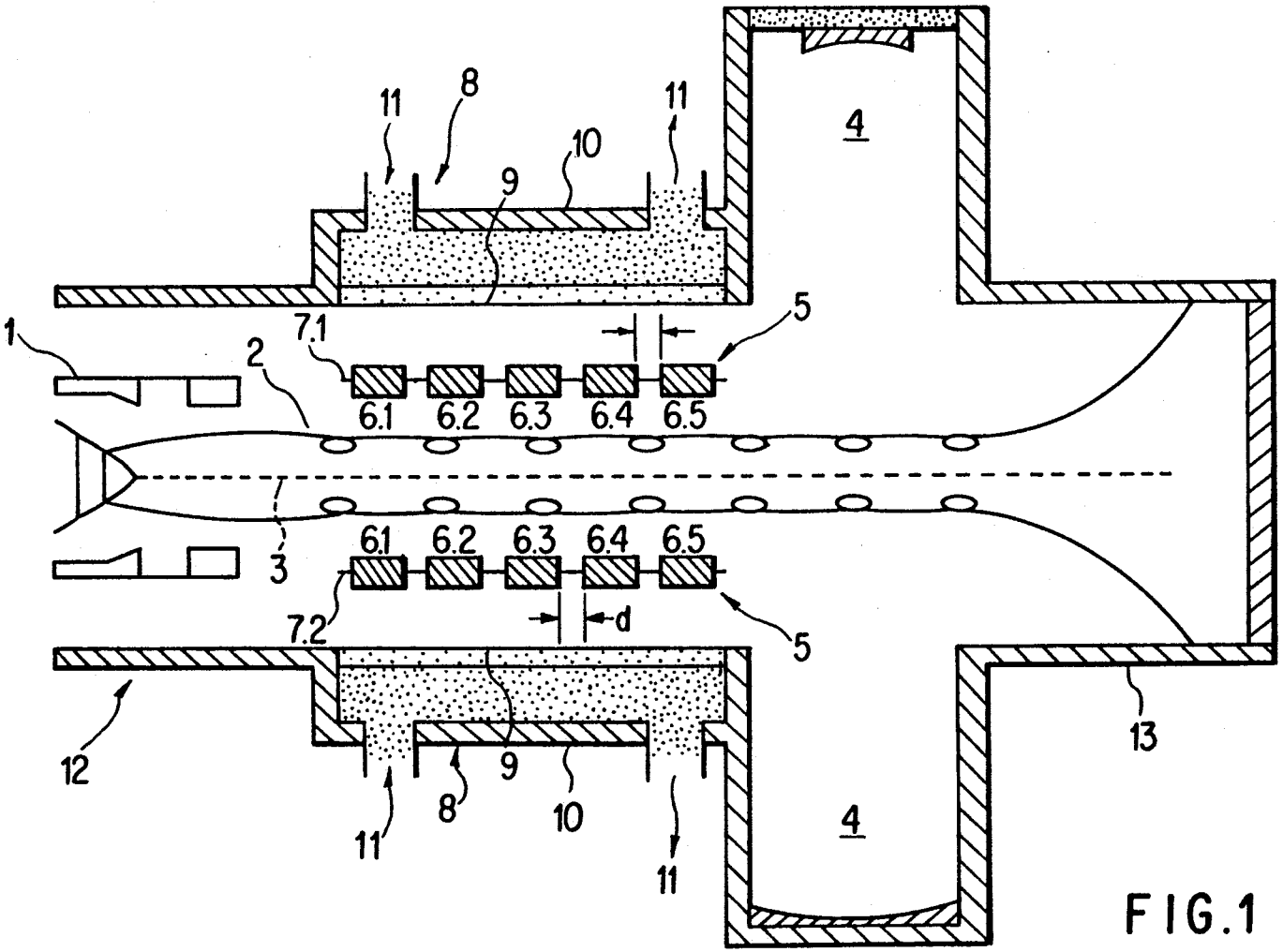
FIG. 1 diagrammatically shows an axial section through a gyrotron according to the invention with integrated absorption device.

In FIG. 1, an electron beam gun 1, for example a magnetron injection gun (MIG for short) known as such is indicated. It generates, for example, an annular electron beam 2 having a diameter of a few millimeters. This runs along an electron beam axis 3, passes through a resonator 4 and finally ends in a collector 13. A strong static magnetic field compresses the electron beam 3 and forces the electrons into gyration.

In the resonator 4, the electrons running along spiral tracks excite a desired electromagnetic alternating field. The microwave radiation thus obtained from the kinetic energy of the electrons is coupled out of the resonator 4 and supplied to a load. In FIG. 1, the resonator 4 is constructed in a quasi-optical manner, that is to say it essentially consists of two reflectors which are opposite to one another on a resonator axis, the resonator axis being located perpendicular to the electron beam axis 3.

It should be noted at this point that the invention is just as suitable for a cylindrical gyrotron. In the cylindrical gyrotron, it is known that the resonator is located coaxially with respect to the electron beam axis 3 in the form of a wave guide.

Between electron beam axis 3 and resonator 4, a drift system is located. The electron beam 2 must be guided along this system, if possible, without impairment of its quality (particularly its energy purity}. For this purpose, a beam guide 5 according to the invention is used as is described in the text which follows.

Several metal rings 6.1, 6.2, . . . , 6.5 are arranged coaxially with respect to the electron beam axis 3. The inside surfaces of these metal rings form the metallic inner surface needed for guiding the electron beam. They have a given mutual spacing d. The resultant intermediate spaces are empty. They represent the openings (diffraction gap) in the inner surface of the beam guide which ensures the microwave radiation is coupled out which has been undesirably excited in the area within the metal rings.

The metal rings 6.1, 6.2, . . . , 6.5 preferably consist of copper. In addition, they should be thin in the radial direction in order to facilitate the coupling-out of the microwave radiation. The number of metal rings is obtained from the required length of the beam guide (for example approximately 300 mm for a quasi-optical gyrotron having an operating frequency of 100 GHz), the distance d and the width of the rings.

According to a preferred embodiment, the metal rings 6.1, 6.2, . . . , 6.5 are kept at a distance with the aid of metal pins 7.1, 7.2. The thin metal pins 7.1, 7.2 have the advantage that the passage of the coupled-out microwave radiation occurs largely unimpeded.

The intermediate space between the metal rings must be dimensioned in such a manner that the unwanted microwave radiation can easily pass. This is the case when the openings have a dimension of about one half wavelength or more in at least one direction. It is the spacing d of the rings which is greater than one half wavelength of the microwaves generated in the gyrotron predominantly in the case of small wavelengths. If, in contrast, the wavelength is relatively large (frequency of less than 70 GHz), it is sufficient if the metal pins have a mutual spacing of at least one half wavelength. The axial spacing of the rings may then by all means be smaller.

So that both TE and TM modes can easily leave the beam guide, especially at low frequencies ($<70$ GHz), it is recommended to construct the beam guide in the manner described below.

Figure 2:
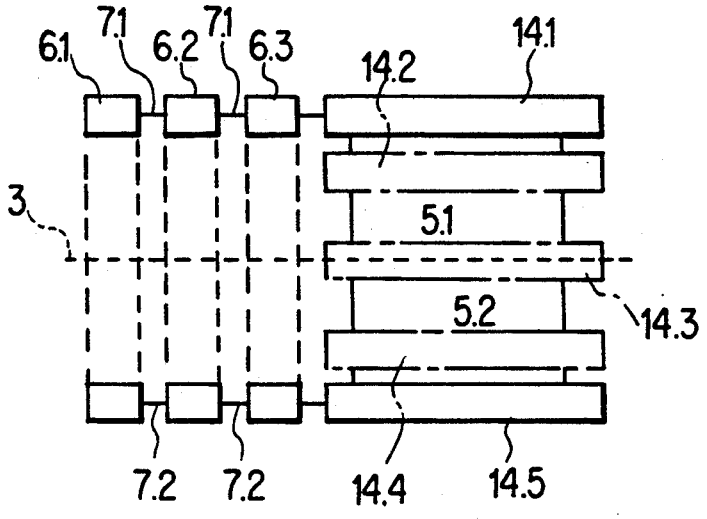
FIG. 2 shows a beam guide for low frequencies.

FIG. 2 shows a beam guide for low frequencies. It exhibits at least two sections, of which the first comprises metal rings 6.1, 6.2, 6.3 of the type described and the second comprises several parallel metal rods 14.1, 14.2, . . . , 14.5. The metal rods 14.1, 14.2, . . . , 14.5 of the second section are fixed in location by suitable holding rings 15.1, 15.2 and also enclose the electron beam (electron beam axis 3) in the form of a jacket (that is to say like the metal rings). The mutual spacing of the metal rods 14.1, 14.2, . . . , 14.5 may be smaller than one half wavelength. The holding rings 15.1, 15.2, in contrast, should not have less than this minimum spacing.

In the beam guide described, the TE modes are coupled out particularly easily in the first section and the TM modes are coupled out particularly easily in the second section. If necessary, several such sections can be alternately connected behind one another.

At high frequencies ($>70$ GHz) there is no selective coupling-out of particular modes. The beam guide can then optionally consist of only rings or of only rods.

There is a preferred upper limit for the spacing d. It is given by one half the difference between the inside radius of the beam guide, that is to say of the relevant metal rings, and the radius of the electron beam 2.

The inside radius of the beam guide is determined by the maximum possible potential drop of the electron beam. Once the inside radius is determined, the spacing d of the metal rings is selected within the framework shown.

As shown in FIG. 1, microwave radiation passing through the intermediate spaces is now destroyed in accordance with the invention by means of a cooled absorption device 8 enclosing the beam guide. The absorption device 8 encloses the beam guide 5 in a jacket form. According to an advantageous embodiment, it is embodied by a double-walled hollow cylinder. The hollow cylinder has an inside wall 9 which consists of ceramics transparent to microwaves. Outside wall 10 and top and bottom of the hollow cylinder are of metal. A cooling medium 11 (for example water) absorbing the microwaves flows through the hollow cylinder.

The microwave radiation scattered radially out of the beam guide 5 is absorbed by the cooling medium 11 in the hollow cylinder. The metallic outside wall ensures that the unwanted electromagnetic radiation cannot emerge out of the gyrotron. It must be noted that there is no risk of thermal overloading of the ceramics because of the flow-type cooling. It is therefore not critical if the ceramics are not optimally transparent to the microwaves and absorb a part thereof. The commercially available and inexpensive aluminum oxide ceramics are therefore quite suitable for the present purposes.

It is known that electron beam gun 1, beam guide 5 and resonator 4 must be accommodated in an evacuated vessel 12. In most cases, this is cylindrical or possibly conical, at least in the area of the drift system. The absorption device is generally accommodated in the vessel 12 which must be provided with suitable passages for the coolant supply and drainage.

Figure 6:
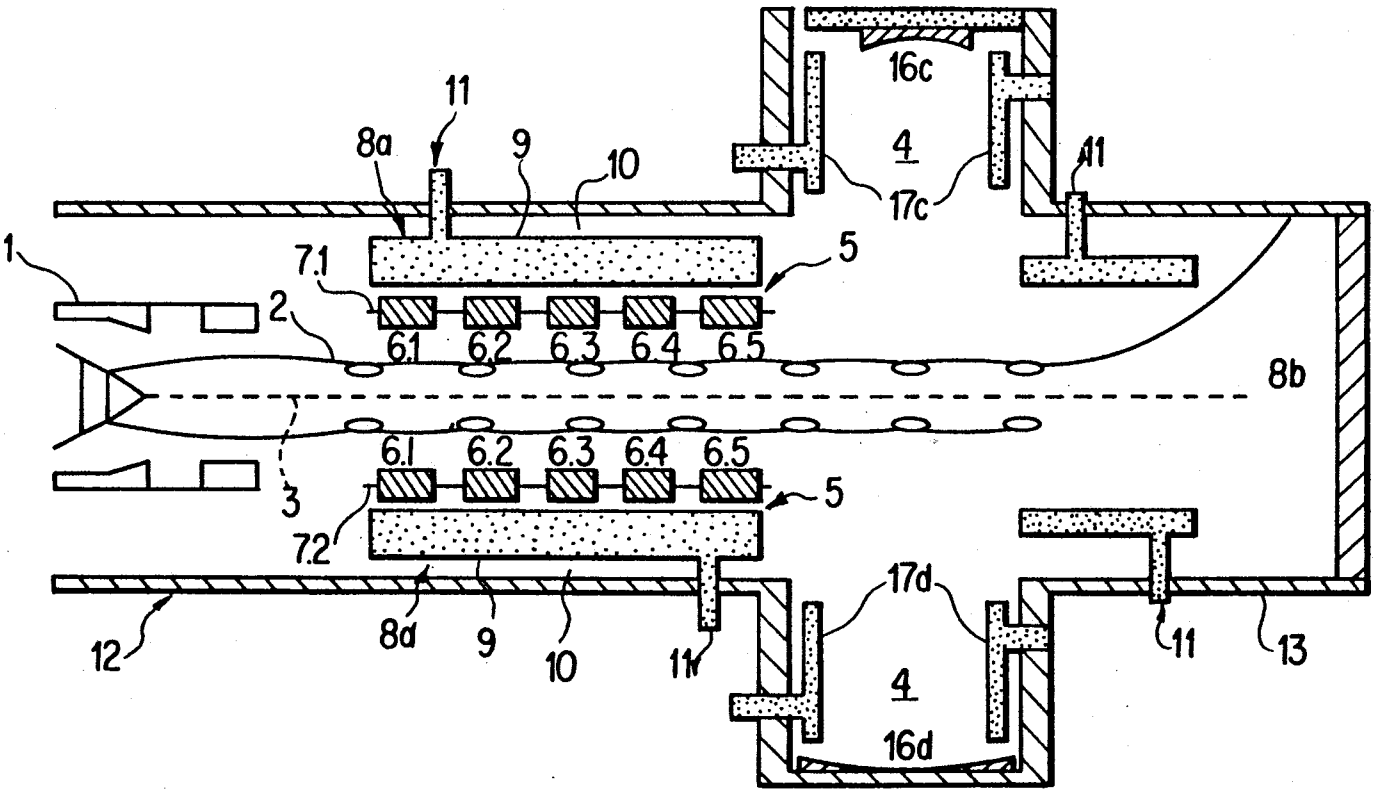
FIG. 6 diagrammatically shows an axial section through a gyrotron comprising absorption structures in the resonator.

FIG. 6 shows a corresponding illustrative embodiment. The absorption device 8*a* is a completely ceramic (double-walled) hollow cylinder which is accommodated in the space between the beam guide 5 and the metallic wall of the vessel 12. Depending on requirement, a further such absorption device 8*b* can be installed behind the resonator 4, that is to say along the electron beam axis 3 between resonator 4 and collector 13. This space, too, can be "contaminated" by microwaves which have an interfering effect on the electron beam 2.

The advantages of an absorption structure consisting completely of ceramics lie in the fact that 1. microwave power lost from the reflector resonator does not inadmissibly heat up the cooled walls of the cryostat for the superconducting magnet but is deliberately destroyed in a high-performance absorber (microwave losses from the resonator cannot be completely avoided), and
2. the production of double-walled damping bodies of materials having identical thermal expansion is simpler.

The absorption device 8*a* thus has a dual function: on the one hand it damps the radiation coupled out of the beam guide 5 and on the other hand, it damps that coming from the resonator.

FIG. 6 also shows the use of the quasioptical component according to the invention in the resonator 4. It comprises in each case a reflector 16*c*, 16*d* (of the resonator) and a cylindrical double-walled vessel 17*c*, 17*d*. These vessels 17*c*, 17*d* are constructed in the manner previously described and absorb the high-power secondary peaks.

According to a preferred embodiment (FIG. 1), the inside wall of the hollow cylinder forms a part of the wall of the evacuated vessel 12. The vessel 12 thus has a cylindrical ceramic insert in the area of the drift system. This means that the vessel 12 is transparent to microwaves in the area of the drift system. The outside wall of the hollow cylinder is then simply placed externally onto the vessel 12. This embodiment is based on the experience that water-tight connections can be achieved more simply than vacuum-tight connections. In the present case, only two vacuum-tight interfaces are necessary. Additional penetrations of the evacuated vessel 12 are completely unnecessary.

Instead of the spaced-apart metal rings, a grid-type beam guide can also be used such as is known from the quoted Patent CH-664,044 A5.

The beam guide is generally not restricted to the section between electron beam gun and resonator. Instead, it can be continued after the resonator. Correspondingly, there can also be an absorption device of the type described after the resonator so that at least the microwave radiation is also absorbed in this area (compare FIG. 6).

The beam guide according to the invention considerably improves the pumping path compared with the prior art. The intermediate spaces also provide the possibility of a radial exhaustion which is not possible in the case of tubes of metal and ceramic rings.

Even though an absorption device should be arranged at the location of the occurrence of a secondary peak in the optimum case, a metal wall of good conductivity can also be provided as reflector. The microwave power is then conducted to the absorber via this metal wall (and, if necessary, via further reflectors).

The invention creates the prerequisites necessary for generating high-power microwaves and transmitting these without hazard. For example, in a 1 MW quasi-optical gyrotron, the diffraction losses are approximately 20 kW. This power would impinge unimpeded on the liquid nitrogen shield of the cryostat which would have to dissipate this power. This would result in a disproportionately high consumption of liquid nitrogen. Furthermore, the stray unchecked microwave power in the gyrotron could be absorbed or coupled in at further unwanted points such as, for example, at the electron gun, electron beam, resonator, RF window, vacuum seals, cable joints, diagnostic systems (for temperature, filling level etc.), high-voltage insulators, and could there lead to operational disturbances or damage. Finally, these microwaves could also emerge from the gyrotron at unwanted places and thus endanger persons and equipment in the vicinity.

In summary, it can be noted that the invention creates the possibility of guiding a high-quality electron beam in a gyrotron.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. Quasi-optical component for microwave radiation, comprising:

a first major axis along which microwave radiation of a certain wavelength propagates through said quasi-optical component;

a quasi-optical element which is situated substantially perpendicular to said first major axis such that said propagating microwave radiation is incident on said quasi-optical element;

said quasi-optical element having a characteristics dimension transverse to said first major axis which is smaller than 50 times said certain wavelength of said microwave radiation;

said quasi-optical element diffracting and re-radiating microwave radiation with a primary peak along a second major axis, substantially parallel with said first major axis, and at least one high-power secondary peak in a direction different from said second major axis, whereby said at least one secondary peak stems from said diffraction of said incident microwave radiation which is due to said characteristic transverse direction of said quasi-optical element; and a cooled absorption device which is arranged closely to said quasi-optical element at a side of said quasi-optical element, wherein the direction of said at least one high-power secondary peak makes an angle with said first major axis between zero and 90° such that said at least one secondary peak of said microwave radiation is absorbed by said absorption device and said primary peak is transmitted without being absorbed by said absorption device.

2. Quasi-optical component as claimed in claim 1, wherein said absorption device comprises:

a vessel transparent to said microwave radiation and filled with a cooling liquid for absorbing said microwave radiation.

3. Quasi-optical device as claimed in claim 2, wherein said vessel comprises, at least partially a ceramic material; and wherein said cooling liquid is water.

4. Quasi-optical component as claimed in claim 1, wherein said quasi-optical element is a focusing reflector.

5. Quasi-optical component as claimed in claim 1, wherein said quasi-optical element is a Vlasov-type convertor.

6. Device for guiding in a gyrotron an electron beam, said electron beam generated by an electron gun and itself being a source of an unwanted radiation of a certain wavelength and frequency, along a gyrotron axis from said electron gun to a collector, said device comprising:

a beam guide in the form of an electrically conductive surface enclosing said electron beam along said axis;

said beam guide having openings in said electrically conductive surface through which said unwanted microwave radiation can pass; and a cooled absorption device enclosing said beam guide and being provided for the absorption of said unwanted microwave radiation passing through said openings in said beam guide;

wherein said beam guide comprises a first section with a plurality of metal rings which are spaced from each other by a certain axial distance along said gyrotron axis, said spaced metal rings defining along said gyrotron axis first intermediate spaces as said openings, and said metal rings being held at said distance between each other with the aid of pins.

7. Device as claimed in claim 6, wherein said beam guide further comprises:

a second section with a plurality of metal rods which are arranged parallel to said gyrotron axis in the form of a jacket around said axis and are spaced circumferentially at a radial distance around said gyrotron axis, said second section coupled in series along said gyrotron axis to said first section, said spaced metal rods defining second intermediate spaces as said openings;

wherein the axial and circumferential distances between said metal rings and said metal rods, respectively, define said openings and are such that TE modes of said unwanted microwave radiation can easily pass through said axial distances and TM modes of said unwanted microwave radiation can easily pass through said circumferential distances even at frequencies of said unwanted microwave radiation of lower than 70 GHz.

8. Device as claimed in claim 7, wherein the axial and circumferential distances are at least one half said wavelength of said unwanted microwave radiation.

9. Device as claimed in claim 6, wherein said cooled absorption device comprises:

a double-walled hollow cylinder with an inner wall and an outer wall coaxially disposed about said axis, said inner and outer wall consisting of a material transparent to said unwanted microwave radiation and confining an inner space through which a cooling medium for absorbing said unwanted microwave radiation flows.

10. Device as claimed in claim 9, wherein said material of said inner and outer walls consists of an aluminum oxide ceramic material, and wherein said cooling medium is water.

11. Cyrotron, comprising:

an evacuated vessel with a gyrotron axis;

an electron gun disposed within said vessel for generating an electron beam along said gyrotron axis, said electron beam being itself a source of an unwanted microwave radiation of a certain wavelength and frequency;

within said vessel a drift system arranged along said gyrotron axis between said electron gun and a collector, comprising a beam guide for guiding said generated electron beam, said beam guide comprising an electrically conductive surface enclosing said electron beam and having openings in said conductive surface for the passage of said unwanted microwave radiation;

within said vessel a resonator arranged along said gyrotron axis between said drift system and said collector;

wherein said electron beam excites within said resonator a desired microwave radiation; and within said vessel a cooled absorption device enclosing said beam guide such that said unwanted microwave radiation which passes through said openings is absorbed within said cooled absorption device;

wherein said beam guide comprises a first section with a plurality of metal rings which are spaced apart from each other by a certain distance along said gyrotron axis, said spaced metal rings defining along said gyrotron axis first intermediate spaces as said openings, and said metal rings being held at said distance between each other with the aid of pins.

12. Gyrotron as claimed in claim 11, wherein said cooled absorption device comprises a double-walled hollow cylinder with an inner and an outer wall coaxially disposed about said axis;

said evacuated vessel comprises a wall;

said inner wall of said cooled absorption device forms a section of said wall of said evacuated vessel; and said outer wall of said hollow cylinder consists of a metal wall and is placed outside said vessel.

* * * * *